US007802352B2

(12) United States Patent
Chitty et al.

(10) Patent No.: US 7,802,352 B2
(45) Date of Patent: Sep. 28, 2010

(54) MONITORING SYSTEM FOR FASTENER SETTING TOOL

(75) Inventors: Eymard J Chitty, Easton, CT (US); Brian Taylor, Glastonbury, CT (US); Peter C Thomas, Cheshire, CT (US); Darren S Byrne, Southbury, CT (US)

(73) Assignee: Newfrey LLC, Newark, DE (US)

( * ) Notice: Subject to any disclaimer, the term of this patent is extended or adjusted under 35 U.S.C. 154(b) by 1179 days.

(21) Appl. No.: 11/396,140

(22) Filed: Mar. 31, 2006

(65) Prior Publication Data

US 2006/0230591 A1 Oct. 19, 2006

Related U.S. Application Data

(60) Provisional application No. 60/671,032, filed on Apr. 13, 2005.

(51) Int. Cl.
*B21D 39/00* (2006.01)
*B23P 11/00* (2006.01)

(52) U.S. Cl. ..... 29/524.1; 29/407.01; 29/407.05; 29/525.06; 29/720; 29/243.53

(58) Field of Classification Search ..... 29/407.01, 29/407.05, 407.08, 407.09, 525.05, 525.06, 29/702, 703, 705, 707, 709, 715, 720, 243.53, 29/243.54, 524.1
See application file for complete search history.

(56) References Cited

U.S. PATENT DOCUMENTS 3,292,413 A 12/1966 Falcioni
3,654,792 A 4/1972 Mead
3,665,742 A 5/1972 Felt et al.
3,685,716 A 8/1972 Frankie et al.
3,920,082 A * 11/1975 Dudek ..... 173/182
4,023,406 A * 5/1977 Benz, Jr. ..... 73/862.24
4,051,351 A 9/1977 Mallick, Jr. et al.
4,116,036 A 9/1978 Sheffield et al.
4,163,311 A * 8/1979 Sigmund ..... 29/407.02
4,182,979 A * 1/1980 Douglas et al. ..... 318/434
4,288,901 A 9/1981 Babcock
4,466,292 A 8/1984 Milazzo
4,811,881 A 3/1989 Heck
4,836,003 A 6/1989 Blake
4,901,431 A 2/1990 Gast (Continued)

FOREIGN PATENT DOCUMENTS

DE 37 15 905 A1 12/1988

(Continued)

OTHER PUBLICATIONS

Tomi d.o.o. Crnomelj in Slovenija, "Mode D'Emploi Du Systeme NISI", Apr. 24, 2001, 8 pages, (English Translation—7 pgs).

(Continued)

*Primary Examiner*—Essama Omgba
(74) *Attorney, Agent, or Firm*—Harness, Dickey & Pierce, P.L.C.

(57) ABSTRACT

A rivet setting tool having a motor driven hydraulic pump is disclosed. The rivet setting tool incorporates a fastener setting verification system configured to monitor changes pump drive motor current to determine if a particular fastener set is acceptable.

19 Claims, 2 Drawing Sheets

U.S. PATENT DOCUMENTS

| | | | | |
|---|---|---|---|---|
| 4,903,783 | A | 2/1990 | Rushanan et al. | |
| 4,914,602 | A | 4/1990 | Abe et al. | |
| 4,995,148 | A | 2/1991 | Bonomi et al. | |
| 5,035,129 | A | 7/1991 | Denham et al. | |
| 5,035,353 | A | 7/1991 | Smart et al. | |
| 5,098,001 | A | 3/1992 | Smart et al. | |
| 5,105,719 | A * | 4/1992 | Yoshikawa | 91/59 |
| 5,136,873 | A | 8/1992 | Hopkins et al. | |
| 5,184,497 | A | 2/1993 | Hanlon et al. | |
| 5,196,773 | A * | 3/1993 | Yoshikawa et al. | 318/561 |
| 5,201,204 | A | 4/1993 | Hinterman et al. | |
| 5,207,085 | A | 5/1993 | Hopkins et al. | |
| 5,315,744 | A | 5/1994 | Denham et al. | |
| 5,323,946 | A | 6/1994 | O'Conner et al. | |
| 5,396,703 | A | 3/1995 | Rice | |
| 5,398,537 | A * | 3/1995 | Michalewski et al. | 72/430 |
| 5,404,643 | A | 4/1995 | Rice | |
| 5,406,500 | A | 4/1995 | Floret | |
| 5,502,884 | A | 4/1996 | Ladouceur | |
| 5,526,669 | A * | 6/1996 | Gjovik et al. | 72/391.2 |
| 5,590,453 | A | 1/1997 | Gajewski | |
| 5,600,878 | A | 2/1997 | Byrne et al. | |
| 5,655,289 | A | 8/1997 | Wille et al. | |
| 5,661,887 | A * | 9/1997 | Byrne et al. | 29/243.525 |
| 5,666,710 | A * | 9/1997 | Weber et al. | 29/243.523 |
| 5,673,839 | A | 10/1997 | Howard et al. | |
| 5,841,675 | A | 11/1998 | Ngo | |
| 5,956,251 | A | 9/1999 | Atkinson et al. | |
| 6,014,804 | A | 1/2000 | Lulay et al. | |
| 6,026,551 | A | 2/2000 | Honsel et al. | |
| 6,079,604 | A | 6/2000 | Banducci et al. | |
| 6,092,275 | A | 7/2000 | Kellner et al. | |
| 6,125,680 | A | 10/2000 | Bradbury et al. | |
| 6,141,849 | A | 11/2000 | Honsel et al. | |
| 6,145,360 | A | 11/2000 | Honsel et al. | |
| 6,176,000 | B1 | 1/2001 | Lulay et al. | |
| 6,237,390 | B1 | 5/2001 | Honsel et al. | |
| 6,240,613 | B1 * | 6/2001 | O'Connor et al. | 29/407.01 |
| 6,256,854 | B1 | 7/2001 | Chitty et al. | |
| 6,276,037 | B1 | 8/2001 | Solfronk | |
| 6,276,050 | B1 | 8/2001 | Mauer et al. | |
| 6,301,948 | B1 | 10/2001 | Weiland | |
| 6,347,449 | B1 | 2/2002 | Calkins et al. | |
| 6,446,319 | B1 | 9/2002 | Lulay et al. | |
| 6,502,008 | B2 | 12/2002 | Maurer et al. | |
| 6,516,896 | B1 * | 2/2003 | Bookshar et al. | 173/1 |
| 6,519,997 | B2 | 2/2003 | Luhm et al. | |
| 6,843,326 | B2 | 1/2005 | Tambini | |
| 6,847,923 | B2 | 1/2005 | Donovan | |
| 6,851,167 | B2 * | 2/2005 | Harlow et al. | 29/407.01 |
| 6,871,586 | B2 | 3/2005 | Teraoka | |
| 6,892,431 | B2 | 5/2005 | Campbell et al. | |
| 6,895,793 | B2 | 5/2005 | Heffron et al. | |
| 6,951,052 | B2 | 10/2005 | Clew | |
| 6,961,984 | B2 | 11/2005 | Naito et al. | |
| 6,981,311 | B2 * | 1/2006 | Seith et al. | 29/707 |
| 7,024,270 | B2 | 4/2006 | Mauer et al. | |
| 7,024,746 | B2 * | 4/2006 | Weeks et al. | 29/407.08 |
| 7,055,393 | B2 * | 6/2006 | Smith | 73/774 |
| 7,123,982 | B2 | 10/2006 | Mauer et al. | |
| 7,331,205 | B2 * | 2/2008 | Chitty et al. | 72/21.1 |
| 7,343,764 | B2 | 3/2008 | Solfronk | |
| 7,346,971 | B2 * | 3/2008 | Chitty | 29/243.523 |
| 7,409,760 | B2 | 8/2008 | Mauer et al. | |
| 7,503,196 | B2 * | 3/2009 | Chitty et al. | 72/21.4 |
| 7,536,764 | B2 * | 5/2009 | Weeks et al. | 29/407.08 |
| 2001/0027597 | A1 | 10/2001 | Mauer et al. | |
| 2003/0074102 | A1 | 4/2003 | Mauer et al. | |
| 2004/0060363 | A1 | 4/2004 | Smith | |
| 2004/0063362 | A1 | 4/2004 | Weeks et al. | |
| 2004/0167660 | A1 | 8/2004 | Mauer et al. | |
| 2004/0189232 | A1 | 9/2004 | Cho | |
| 2005/0155221 | A1 | 7/2005 | Fulbright | |
| 2007/0079504 | A1 | 4/2007 | Fulbright | |
| 2008/0319570 | A1 | 12/2008 | Van Schoiack | |

FOREIGN PATENT DOCUMENTS

| | | | |
|---|---|---|---|
| DE | 42 17901 | A1 | 12/1993 |
| DE | 44 01 155 | A1 | 7/1995 |
| DE | 44 29 225 | A1 | 2/1996 |
| DE | 19630384 | A1 | 4/1998 |
| DE | 100 64 243 | A1 | 7/2002 |
| DE | 102 48 298 | A1 | 7/2003 |
| DE | 202 10 840 | U1 | 7/2003 |
| EP | 0454890 | A | 11/1991 |
| EP | 462707 | A2 | 12/1991 |
| EP | 0572819 | A1 | 12/1993 |
| EP | 0 594 333 | A1 | 4/1994 |
| EP | 0 738 550 | A2 | 4/1996 |
| EP | 0 738 551 | A2 | 10/1996 |
| EP | 0 893 179 | A2 | 1/1999 |
| EP | 0 905 518 | A2 | 4/2000 |
| EP | 0 995 519 | A2 | 4/2000 |
| EP | 1 302 258 | A1 | 4/2003 |
| EP | 1 382 406 | A2 | 1/2004 |
| EP | 1 447157 | A1 | 8/2004 |
| EP | 1 506 846 | A1 | 2/2005 |
| JP | 56-6540 | | 1/1981 |
| JP | 56-99037 | | 8/1981 |
| JP | 62-77146 | | 4/1987 |
| JP | 62-252631 | | 11/1987 |
| JP | 63-2534 | | 1/1988 |
| JP | 63-260640 | | 10/1988 |
| JP | 3-216230 | | 9/1991 |
| JP | 04169828 | A | 6/1992 |
| JP | 6-050862 | | 2/1994 |
| JP | 6-190489 | | 7/1994 |
| JP | 7-015135 | | 3/1995 |
| WO | WO 00/21700 | | 4/2000 |
| WO | WO00/25416 | | 5/2000 |
| WO | WO 02/43898 | | 6/2002 |
| WO | WO 03/000445 | | 1/2003 |
| WO | WO 03/059550 | | 7/2003 |
| WO | WO 03/059551 | | 7/2003 |

OTHER PUBLICATIONS

Sciemetric Instruments Inc., "Sciemetric SigMETER, Intelligent Signature Analysis Meter", 8 pgs.

Sciemetric Instruments Inc., New Directions 1100 Series, Sciemetric, The Panel Meter of System Proportions SigMETER, 4 pgs.

http://www.sciemetric.com/whatsnew/main2.html, "What's New?, More NEW Products to Support Your ZERO DEFECT Manufacturing Goals", 2001, 6 pgs.

http://www.sciemetric.com/company/main.html, "Company Profile", 2001, 2 pgs.

http://www.sciemetric.com/products/model298/main.html, "Products", 2001, 1 pg.

* cited by examiner

MONITORING SYSTEM FOR FASTENER SETTING TOOL

CROSS-REFERENCE TO RELATED APPLICATIONS

This application claims the benefit of U.S. Provisional Application No. 60/671,032, filed on Apr. 13, 2005. The disclosure of the above application is incorporated herein by reference.

FIELD OF THE INVENTION

One field of the present invention relates generally to fastening machines and, more particularly, to a fastener setting system having a remote hydraulic power supply with a fastener set monitoring system and methods for operating the fastener setting system.

BACKGROUND AND SUMMARY

Mechanical assemblies often use fasteners and typically blind rivets to secure one or more components together in a permanent construction. Blind rivets are preferred where the operator cannot see the blind side of the workpiece for instance where the rivet is used to secure a secondary component to a hollow box section. Also they are preferred where a high volume of assemblies are being produced as there are advantages to be gained from increased assembly speeds and productivity compared with threaded or bolted joints.

One of the disadvantages of a blind rivet setting to a hollow box section is that the blind side set end of the rivet cannot be visually inspected for a correctly completed joint. This is especially relevant where there are a number of blind rivets used and these are of a multiplicity of different sizes in both diameter and length. In addition, there could be occasions where assembly operators are inexperienced or the arrangements of rivets are complex. Further, it is possible that rivets are incorrectly installed or perhaps not installed at all. To inspect assemblies after completion is not only expensive and unproductive and in some instances, it is virtually impossible to identify if the correct rivet has been used in a particular hole. A further consideration can be that modern assembly plants are using increasing numbers of automative rivet placement and setting tools where there is an absence of the operator.

The current monitoring of a rivet during the setting process has been limited to the use of two classes of methods. The first method employs the use of a hydraulic pressure transducer, which measures working fluid pressure within the tool. This current method is limited to use in detecting fluid pressure alone. The second method uses a "load cell" mounted linear to the tool housing. This option uses equipment, which is considerably larger and has limited field capability as a result. Typically, the second method additionally uses a LVDT to measure the translations of the various moving components.

In accordance with the present invention, a system is provided that will continually monitor the setting process, the numbers of rivets set and the correctness of setting and to identify if there are small but unacceptable variations in rivet body length or application thickness. In addition, because assembly speeds are increasing, it is an advantage to identify incorrect setting almost immediately instead of a relatively long delay where complex analysis of rivet setting curves is used. Other fasteners such as blind rivet nuts (POP®nuts), self-drilling self-tapping screws or even specialty fasteners such as POP®bolts can be monitored but for the purposes of this description, blind rivets are referred to as being typical of fasteners used with this monitoring system.

There are a variety of different types of tools, both manual and powered, that are used to set pull-type or swage-type fasteners. For industrial production, it is desirable to use a power tool that may have an air/hydraulic or hydraulic/hydraulic power assist to pull the mandrel stem. This facilitates the rivet setting operation.

To overcome the disadvantages of the prior art, a fastener set monitoring system is provided which has a sensor that measures motor current, torque or RPM within a tool component. In this regard, the system utilizes sensors to monitor variations in current or torque in a servomotor used to drive a hydraulic pump. These measured currents or torque are compared to a data array or function which represents data conforming to an acceptable fastener set. Various techniques are provided to analyze the measured data with respect to the tolerance bands to determine if a particular river set is acceptable.

In one embodiment, a fastener setting tool having a hydraulically driven pulling head for engaging and setting a fastener and upon actuation is provided. The rivet setting tool has a hydraulic pressure source coupled to the riveting head and an intensifier operably coupled to the hydraulic pressure source. A servomotor is coupled to a pump to form the hydraulic pressure source that is configured to apply fluid pressure to cause the setting of the fastener.

In another embodiment, a fastener setting tool is provided having a pulling head which has a hydraulic pressure source coupled to a fastener engaging member. The hydraulic pressure source is formed of a pump, which is driven by a servomotor. A sensor is used to measure current or torque within the servomotor over a fastener set event. These measured torque or current values are compared in a time or displacement domain to tolerance bands formed about median current or torque versus time or displacement data. Various techniques are provided to analyze the measured data with respect to the tolerance bands to determine if a particular river set is acceptable.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
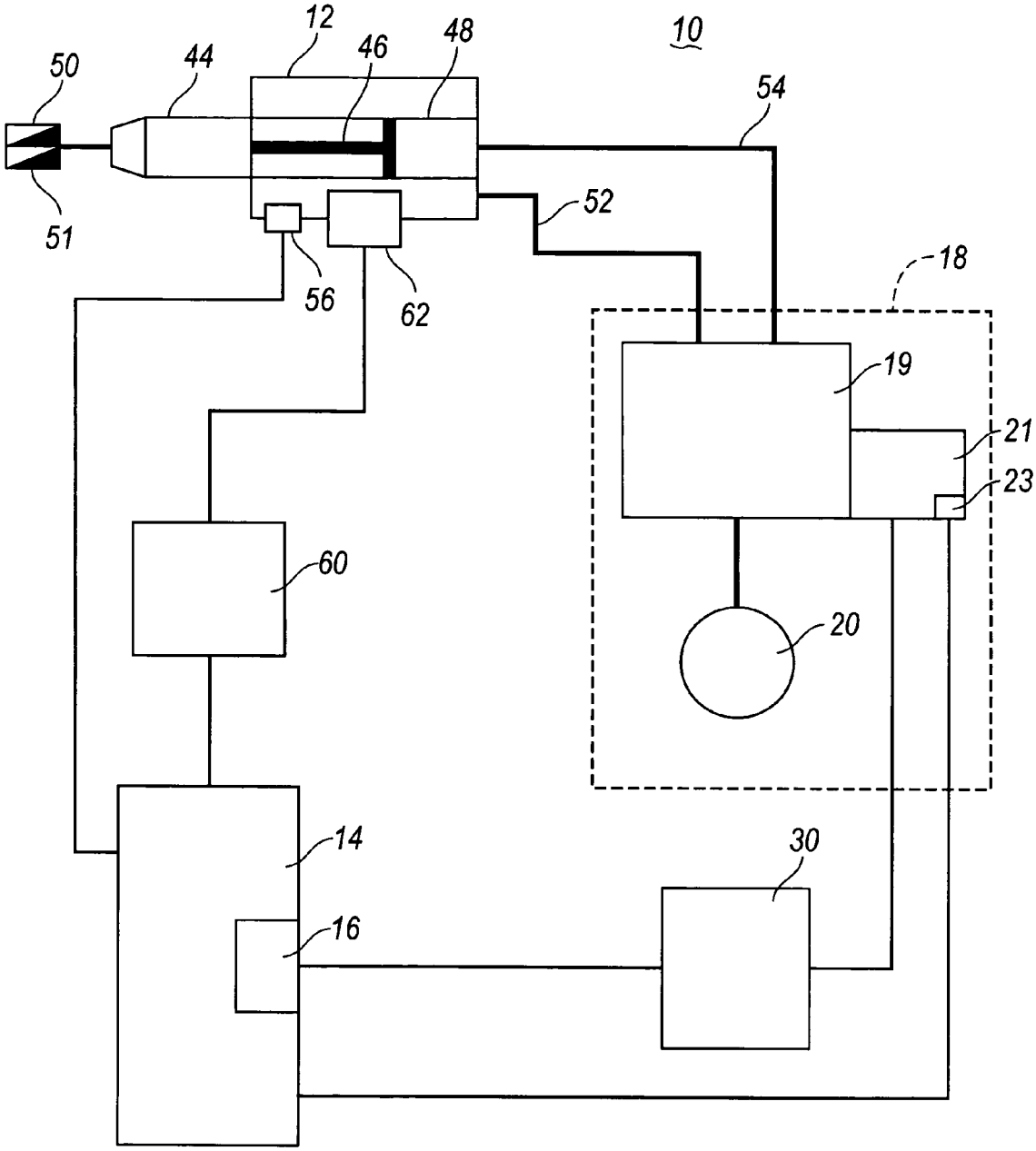
FIG. 1 represents a system overview of the fastener setting system according to the teachings of the present invention.

The following description of the preferred embodiment(s) is merely exemplary in nature and is in no way intended to limit the invention, its application, or uses. With reference to FIG. 1, the fastening system 10 according to the present teachings is shown. Shown is a rivet setting tool 12 operably coupled to an electronic controller 14, hydraulic controller 16, and a hydraulic fluid supply 18.

The rivet setting tool 12 includes a pulling head 44 which includes a hydraulic piston 46 within a machined aluminum housing 48. The hydraulic piston 46 is connected to jaw case 50 via a coupling so that during activation, i.e., hydraulic pressure supplied by a hydraulic hose 52 on the face of the hydraulic piston 46, the jaws 51 ramp off a nose piece, and engage the rivet mandrel. Continued travel provides enough force and stroke to set the average rivet. The pulling head 44 employs air or oil pressure via hydraulic tube 54 on the opposite side of the hydraulic piston 46 to return the hydraulic piston 46 to its full forward position once hydraulic pressure is removed.

The hydraulic supply hose 52 is connected to the hydraulic fluid supply 18. The hydraulic fluid supply 18 has an oil reservoir 20 coupled to the pump 19 which is driven by a servomotor 21. The servomotor 21 is either an A/C or D/C servomotor that draws a variable amount of current depending on the load presented by the pump 19. The pump 19 is optionally a constant flow pump. The servomotor 21 is driven by a servomotor driver 30, which is coupled to the hydraulic control 16 incorporated within the controller 14. A sensor 23 is provided which measures "Data" that can be optionally, either the servomotor current or the torque applied by the servomotor during a fastener-setting event. Alternatively, the sensor 23 provides a signal indicative of the rpm the servomotor 21.

The controller 14 is configured to provide a signal to the servomotor driver 30 upon the initiation of the rivet set event. The servomotor driver 30 then drives the servomotor 21, which in turn drives the hydraulic pump 18 to drive the piston 46 to set the fastener. Additionally, the controller can measure piston displacement values using a LVDT 56 or other device operable to measure a property indicative of displacement.

The controller 14 is configured to monitor "Data" in the form of current, torque or and/or RPM of the pump drive motor to determine when the fastener set event has ended and whether a particular set is of acceptable quality. In this regard, the controller 14 is configured to detect a large drop in the current that is indicative of the setting of a fastener. Upon mandrel break or fastener set, the controller 14, 16 stops activating the pump's servomotor 21, and starts activating a remote valve (not shown) supplying a regulated supply of fluid on top of hydraulic piston 46. The fluid behind the pulling head piston 46 of the pulling head 44 disposed within the rivet setting tool 12, quickly returns the pulling head 44 and jaw case 50 to the retracted position. Optionally, the pump 19 can be used to apply pressure or suction to the fluids on either side of the piston 46 to return the piston to its proper location. Fluid supplied to the top of the hydraulic piston 46 is controlled by the riveting system controller 14 and shuts off after approximately one second.

The controller 14 is configured to use several methods for determining the quality of a fastener set within a setting tool. The method includes the step of first, defining a set of example "Data" time/displacement data in the form of an array. "Data" for a rivet setting process, which is being evaluated, is sensed and recorded. The sensed "Data" is aligned by time or displacement values with the series of example "Data" time/displacement data. The occurrence of the highest value of the measured "Data" is used to identify the mandrel breakpoint of the measured "Data" time/displacement data. This measured breakpoint current value is compared with a predetermined desired breakpoint "Data" value in the example array. The measured "Data" time/displacement signals are then compared to the example "Data" time/displacement signals.

In both the case of the example "Data" information and the measured "Data" information, graphs or wave forms based on these series in the time domain or the displacement domain can be produced. These waveforms can be scanned for predetermined characteristics, which are used to align the data. As previously mentioned, this can be the highest detected "Data", a predetermined "Data", or may be another feature such as a first local maximum or minimum above a given "Data" value, or after a predetermined time or displacement.

For example, when monitoring the setting of a fastener, the current within a pump servomotor 21 of fastener setting tool is monitored during a fastener setting process to produce a series of current signals related thereto. Each of these signals is assigned an appropriate time value to produce an array of signal/time data. Alternatively, the signals are assigned an appropriate displacement value from the optional LVDT 56. The initiation of the fastener setting process is defined either with a trigger or changes in the data, as is the ending of the process. Optionally, this can be defined by a peak current or torque that correlates to the setting of the fastener. The total time/displacement of a member of the fastener-setting event is determined and compared with a predetermined desired value. In addition, the system can utilize the servomotor torque to determine whether it falls within a predetermined tolerance band around a predetermined torque value indicative of the setting of the fastener.

To form an example current or torque time/displacement data, a statistically significant number of training measured signals are received and combined to form a representative array of data. A tolerance band is defined with respect to the representative array which is indicative a predetermined level of quality of the joint. The controller will compare the measured data with these tolerance bands to give an indication of the quality of the rivet set. Optionally, the tolerance band and/or the representative curve can be described as a polynomial function, which can be used to evaluate particular rivet sets. In this regard, after alignment, measured data is compared to the function to determine if the data is above or below the tolerance band curve.

It is further envisioned that system can incorporate a fastener set verification system 60 to determine fastener set quality. The setting tool 12 can include a miniature pressure or strain sensor 62 positioned generally adjacent a bleed/fill screw or on the body 48 which is configured to measure changes in hydraulic pressure or strain within the tool.

Stresses are induced into the housing 48 from compression of various components which are in turn transmitted through the tool. The retraction of the mandrel setting mechanism forces from the jaw housing 48, to compress the hydraulic fluid within the cast body 54. These transmissions result in compression of the hydraulic fluid that can be analyzed to determine if a fastener set is acceptable. The system 32 described uses various methods to analyze the generally arbitrary strain and pressure signals to provide an indication of rivet set quality. Furthermore, the controller 14 can be used to conduct a number of various analysis techniques on the data provided. Additionally, the controller can use inputs from various sensors such as strain sensors appended to various components of the system. These techniques and sensors are described in co-assigned PCT Application PCT/US2005/009461 filed on Mar. 22, 2005 incorporated herein by reference.

Figure 2:
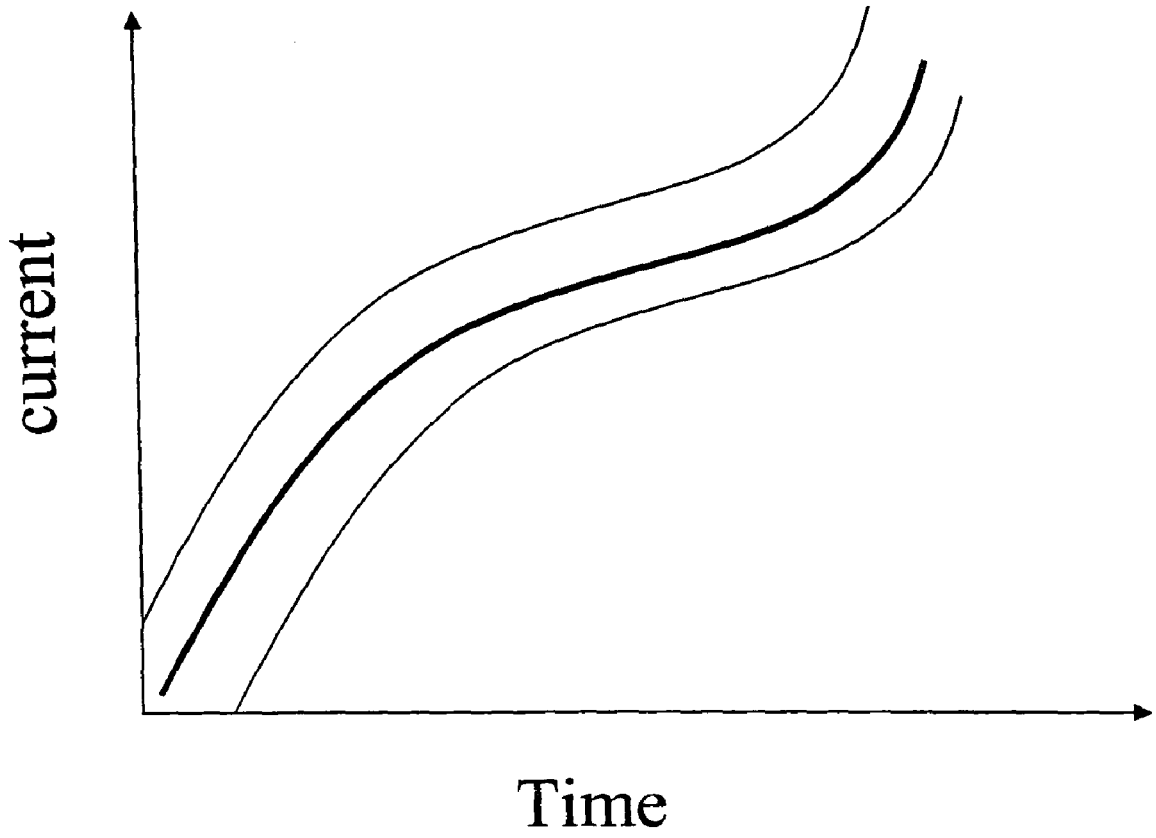
FIG. 2 represents a current vs. time or displacement curve for a typical rivet set.

FIG. 2 represents a tolerance curve or band disposed upon a median or example current. In this system, optionally, portions of the median curve have a specific fixed size tolerance band defined around it. Optionally, the tolerance band can vary depending on the portion of each curve. For example, during a rivet set event, the initial sheet take up and deformation of the rivet body is shown in the first portion of the curve, the tolerance band is set for a first value, but while the final hole filling and joint consolidation is taking place, the tolerance band is adjusted. The system then tracks the current or torque versus time/displacement of an individual fastener set to determine whether it falls outside of the tolerance band. In case the rivet does fall outside of the specific tolerance band, an alarm or warning is presented to the operator.

It is further envisioned that various aspects of the present invention can be applied to other types of rivet machines, for example, the system can be used with self-piercing rivets or pin and collar fasteners or other deformable and frangible fasteners, although various advantages of the present invention may not be realized. Further, the system can be used to set various types of fasteners, for example, multiple piece fasteners, solid fasteners, clinch fasteners or studs. The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fastener setting tool, comprising:

a pulling head including a hydraulic piston disposed within a housing, said piston coupled to a jaw, the jaw operable to engage a fastener upon activation of the pulling head, whereby continued travel of the hydraulic piston applies force to effectively set the fastener;

a hydraulic pressure source connected to said housing by a hydraulic passage, said hydraulic pressure source having a drive motor;

a sensor configured to measure changes in at least one of current, torque or RPM in the motor during a fastener setting event; and a controller configured to accept data from the sensor and produce a signal indicative of an acceptable fastener set.

2. The fastener setting tool according to claim 1 wherein the hydraulic pressure source comprises a hydraulic pump.

3. The fastener setting tool of claim 2 wherein the motor is a servomotor.

4. The fastener setting tool of claim 3 wherein the servomotor is an A/C servomotor.

5. The fastener setting tool of claim 4 wherein the jaw is slidably disposed within the pulling head.

6. The fastener setting tool according to claim 1 further comprising a circuit configured to: (a) store a predetermined torque vs time data, (b) define tolerance bands about the torque vs time data, (c) compare a set of measured torque data to the tolerance bands to determine if a fastener set is acceptable.

7. The fastener setting tool according to claim 1 further comprising a circuit configured to: (a) store a predetermined current vs time data, (b) define tolerance bands about the current vs time data, (c) compare a set of measured current data to the tolerance bands to determine if a fastener set is acceptable.

8. The fastener setting tool according to claim 1 further comprising a circuit configured to: (a) store a predetermined rpm vs time data, (b) define tolerance bands about the rpm vs time data, (c) compare a set of measured rpm data to the tolerance bands to determine if a fastener set is acceptable.

9. A fastener setting tool comprising:

a fluid actuatable member, the setting member operable to engage and set a fastener;

a fluid source having a pump driven by a servomotor operable to convey force to the setting member;

a first sensor configured to measure changes in current in the servomotor during a fastener set event; and a controller configured to accept data from the first sensor and produce a signal indicative of an acceptable fastener set.

10. The fastener setting tool according to claim 9 wherein the servomotor is an A/C servomotor.

11. The fastener setting tool according to claim 9 wherein the means for applying fluid pressure to the setting member comprises a pump fluidly coupled to the setting member and wherein said motor is a servomotor coupled to the pump.

12. The fastener setting tool according to claim 9 further comprising a second sensor configured to measure changes in fluid pressure.

13. The fastener setting tool according to claim 9 wherein the servomotor is a D/C servomotor.

14. The fastener setting tool according to claim 13 wherein the pump is a constant flow pump.

15. A rivet setting tool, comprising:

a servomotor driving a hydraulic supply;

a pulling head including a hydraulic piston disposed within a housing, said piston coupled to a jaw, the jaw operable to engage a rivet mandrel upon activation of the pulling head, whereby continued travel of the hydraulic piston supplies force to effectively set the rivet; and a sensor configured to output signals indicative of changes in said servomotor current during a rivet set event;

a controller configured to, (a) monitor the changes in servomotor current during a rivet setting process and producing a series of signals related thereto;

(b) monitor one of the time of or displacement of the piston during said rivet setting process and producing a series of indexing signals related thereto;

(c) identify the occurrence during the rivet setting process of a peak current;

(d) identify the occurrence of the initiation of the rivet setting process;

(e) use the occurrence of the peak current to identify the set point of the fastener;

(f) determine one of the total time or total displacement of the fastener setting event at the mandrel breakpoint; and (g) compare one of the total time or total displacement with a predetermined desired value.

16. The fastener setting tool according to claim 15 wherein the servomotor is an A/C servomotor.

17. A method of setting a fastener with a setting tool having a motor driven hydraulic supply, a fastener engaging assembly for engaging said fastener and an axially movable piston assembly operatively coupled to said engaging assembly for driving said fastener in response to the application of pressurized hydraulic fluid to said piston assembly; said method including the steps of:

(a) monitoring at least one of the current, torque, or RPM of the motor during a rivet setting process and producing a series of measured signals related thereto;

(b) monitoring the time of said fastener setting process and producing a series of time signals related thereto;

(c) identifying the occurrence during the fastener setting process of a peak measured signal;

(d) identifying the occurrence of the initiation of the fastener setting process;

(e) using the occurrence of the peak measured signal to identify a breakpoint of a portion of the fastener;

(f) determining the total time of the fastener setting event at the fastener set point; and (g) comparing the total time with a predetermined desired value.

18. The method of claim 17 further including the steps of:

producing an array of measured value-versus-time data based on said series of measured signals and said series of time signals produced over the fastener setting process;

scanning said array to identify the location of a measured value in said array; and using the location of the measured value peak to identify the total time of the fastener set event.

19. The method for setting a blind rivet according to claim 18 including the additional steps of:

comparing the array with an example array to determine if the rivet set is acceptable.

* * * * *